US009556616B2

(12) United States Patent
Wang

(10) Patent No.: US 9,556,616 B2
(45) Date of Patent: Jan. 31, 2017

(54) LIGHT ROOFING SYSTEM

(71) Applicant: HAINAN SEQUOIA CREATION CO., LTD., Haikou (CN)

(72) Inventor: Zhong Wang, Haikou (CN)

(73) Assignee: Hainan Sequoia Creation Co., Ltd., Haikou (CN)

( * ) Notice: Subject to any disclaimer, the term of this patent is extended or adjusted under 35 U.S.C. 154(b) by 184 days.

(21) Appl. No.: 14/385,741

(22) PCT Filed: Mar. 12, 2013

(86) PCT No.: PCT/CN2013/072450

§ 371 (c)(1),
(2) Date: Sep. 16, 2014

(87) PCT Pub. No.: WO2013/139214

PCT Pub. Date: Sep. 26, 2013

(65) Prior Publication Data

US 2015/0064443 A1 Mar. 5, 2015

(30) Foreign Application Priority Data

Mar. 19, 2012 (CN) ..... 2012 1 0073416

(51) Int. Cl.

| | |
|---|---|
| ***E04D 1/20*** | (2006.01) |
| ***E04D 11/02*** | (2006.01) |
| ***E04D 1/16*** | (2006.01) |
| ***E04D 1/28*** | (2006.01) |
| ***E04D 1/36*** | (2006.01) |
| ***E04D 7/00*** | (2006.01) |

(52) U.S. Cl.

CPC . *E04D 1/20* (2013.01); *E04D 1/16* (2013.01); *E04D 1/28* (2013.01); *E04D 1/36* (2013.01); *E04D 7/00* (2013.01); *E04D 11/02* (2013.01); *Y10T 428/25* (2015.01); *Y10T 428/251* (2015.01); *Y10T 428/252* (2015.01)

(58) Field of Classification Search

CPC ..... E04D 1/20
USPC ..... 428/324
See application file for complete search history.

(56) References Cited

U.S. PATENT DOCUMENTS 5,859,095 A * 1/1999 Moyle ..... C09D 163/00 523/402
2002/0189186 A1* 12/2002 Smith ..... E04D 3/30 52/518

FOREIGN PATENT DOCUMENTS

| | | |
|---|---|---|
| CN | 1206299 | 6/2005 |
| CN | 101302880 | 11/2008 |
| CN | 101311456 | 11/2008 |
| CN | 201826400 | 5/2011 |
| CN | 102330487 | 1/2012 |
| CN | 202164750 | 3/2012 |
| CN | 102587591 | 7/2012 |
| CN | 1441015 | 9/2013 |
| GB | 605685 | 1/1946 |
| JP | 54425 | 1/1979 |

OTHER PUBLICATIONS

International Search Report, issued in PCT Application No. PCT/CN2013/072450, mailed Jun. 13, 2013, 4 pages.
Construction Atlas for Standard Designs of Buildings in South-central China, Oct. 24, 2005, Zhongnan Diqu Jianzhu Biaozhun Sheji, 73 pages.

* cited by examiner

*Primary Examiner* — Doris Lee
(74) *Attorney, Agent, or Firm* — Schwabe, Williamson & Wyatt, P.C.

(57) ABSTRACT

A light roofing system is formed of a substrate layer and a waterproof surface layer. The waterproof surface layer comprises a functional coating layer made of functional paint and a waterproof layer made of waterproof paint, the functional paint comprises a base material and functional materials, and the functional materials comprise an inorganic flaky material, an inorganic high-rigidity wear-resistant material, and polymer powder with good toughness. The addition amount of the inorganic flaky material accounts for 1% to 8% of the total weight of the functional paint, the addition amount of the inorganic high-rigidity wear-resistant material accounts for 2% to 15% of the total weight of the functional paint, and the addition amount of the polymer powder with good toughness accounts for 1% to 8% of the total weight of the functional paint.

8 Claims, 2 Drawing Sheets

LIGHT ROOFING SYSTEM

The present application claims priority of Chinese Patent Application No. 201210073416.7, filed with the State Intellectual Property Office of China on Mar. 19, 2012, entitled "Light Roofing System", which is incorporated herein by reference in its entirety.

TECHNICAL FIELD

The present invention relates to the technical field of roofing structures, and particularly to a light roofing system with a simple structure.

BACKGROUND

In recent years, energy crisis has been becoming increasingly fierce all around the world and has become an important subject for the sustainable development of our nation and society. Building energy consumption accounts for about 30% of national total energy consumption of developed countries. Under the circumstance of energy-saving and emission-reduction, there is an increasing demand of energy-saving for engineering construction.

As shown in FIG. 1, existing building roofing systems, such as the accessible roofing in "中南地区建筑标准设计建筑图集 (Construction Atlas for Standard Designs of Buildings in South-central China)", are formed by combination of multi-layered, multiple materials such as a substrate layer 1, a sloping layer 2, a leveling layer 3, a waterproof layer 4, a thermal insulation layer 5, an isolating layer 6, a protective layer 7, a decorative layer 8 and the like. Although they can achieve such functions as waterproofing, thermal insulation and heat preservation of the building roofing, the following obvious defects are inevitably present due to the multi-layer structure thereof:

1. Since they are comprised of a multi-layer structure with various kinds of materials, the construction process is complex and cumbersome, the material consumption is large, the construction period is long, professional constructors are needed, and costs are high;

2. Since materials used are mainly mortar, waterproof rolls, waterproof paint, heat preservation materials and other building materials, there is a huge burden for the bearing structure of the building, a large consumption of rebar materials and a large consumption of energy and building materials during construction;

3. Due to inconsistent expansion coefficients of materials in different layers, the structure of multi-layer stacking with different materials tends to cause roofing cracking and water leakage;

4. For a structure of multi-layer stacking, the outermost protective layer is mainly comprised of rigid materials such as cement mortar. Once an artificial or natural damage occurs in the roofing structure, it is difficult to be troubleshot and detected, and the only option is to remove it wholly and rebuild, which results in a large resource consumption and a high maintenance cost;

5. A large amount of unrecoverable materials are needed to be consumed during construction and maintenance of the existing roofing systems, and therefore many construction wastes are produced, which results in not only consumption of excessive resources, but also damage to the environment;

6. Most of the materials used in the existing roofing systems comprise inflammable materials, in particular waterproof and thermal insulation materials, which will even produce toxic fumes when they are burned and therefore have larger security risk.

SUMMARY

In view of this, the object of the present invention is to provide a light roofing system, which can achieve such functions as waterproofing and thermal-insulation with a simple structure, as well as reduce the difficulty in construction and maintenance.

In order to solve the above technical problems, the technical solution of the present invention is as follows.

A light roofing system comprised of a substrate layer and a waterproof surface layer, the waterproof surface layer comprising a functional coating layer made from a functional paint and a waterproof layer made of a waterproof paint, the functional paint comprising a base material and a functional material, the functional material comprising an inorganic flaky material, an inorganic high-rigidity wear-resistant material and polymer powder with good toughness, the addition amount of the inorganic flaky material accounting for 1% to 8% of the total weight of the functional paint, the addition amount of the inorganic high-rigidity wear-resistant material accounting for 2% to 15% of the total weight of the functional paint, and the addition amount of the polymer powder with good toughness accounting for 1% to 8% of the total weight of the functional paint. In this technical solution, the base material can be selected from any one of aqueous reflective thermal-insulating paints in the prior art, and thus is not particularly described here. In this technical solution, to the base material is added a material with a good isolation effect against solar ultraviolet radiation—an inorganic flaky material in an amount of 1% to 8% of the total weight of the paint which isolates the ultraviolet radiation and protects the base material of the coating film from an ultraviolet aging effect; a highly wear-resistant filler—an inorganic high-rigidity wear-resistant material in an amount of 2% to 15% of the total weight of the paint which enhances the wear-resistance of the coating film surface; and an organic polymer powder—a polymer powder with good toughness in an amount of 1% to 8% of the total weight of the paint, which enhances the toughness of filler particles on the coating film surface, and reduces the wear of the rigid filler and the abrasion of the base resin.

Preferably, the waterproof layer is formed by coating the waterproof paint on the substrate layer.

Preferably, the waterproof surface layer further includes a finish paint layer which is located on the outmost side of the waterproof surface layer.

Preferably, the inorganic flaky material is any one or a mixture of two or more of sericite, glass flake, micaceous iron oxide. Sericite powder, glass flake, or micaceous iron oxide is selected as the inorganic flaky material. Particles of such flaky powders generally have an aspect ratio of between 1:10 and 1:50, and under an external pressure of the paint application, these particles are arranged in parallel along the direction vertical to the external pressure. If the addition amount of such a flaky material in the paint is sufficient, these particles will overlap. Many particle layers with such an arrangement in the coating film form a natural barrier for ultraviolet light. Inorganic materials like sericite and glass flake are selected due to their less destructive effect of ultraviolet light on such materials and longer time for ultraviolet isolation. Meanwhile, these inorganic ultraviolet-isolating materials have a much longer effective service life than organic ultraviolet absorbers. However, generally, in the conventional reflective thermal-insulating paint, such a flaky inorganic material is not added. Even if such a flaky material is added, the addition amount is very little; and the purpose of the addition is not for keeping out ultraviolet, but for improving the suspension property of other filling particles in the paint and preventing precipitation.

Preferably, the addition amount of the inorganic flaky material accounts for 3% to 5% of the total weight of the functional paint.

Preferably, the inorganic high-rigidity wear-resistant material is any one or a mixture of two or more of quartz sand, barite, and zirconium oxide. A high-rigidity inorganic material has excellent performances in term of wear-resistance and scratch resistance, and is suitable for roofing paint. The fillers added into the conventional reflective thermal-insulating paint are mostly powders such as kaolin, talc, calcium carbonate, titanium dioxide, etc., which are soft powders with a very low hardness and a poor wear-resistance, and the coating film made from these materials has poor wear-resistance and scratch resistance. In this technical solution, the addition of a high-rigidity filler increases the hardness of the coating film and improves the wear-resistance. When Quartz sand, barite or zirconium oxide is selected as the inorganic high-rigidity wear-resistant material, these high-rigidity particles are embedded into the base material of the polymer film-forming substance when the coating film is formed, and when the surface of the coating film is subjected to the external friction, the high-rigidity particles bear most of the friction force, reduce the abrasion of the coating film surface, and at the same time protect the base material from being scratched.

Preferably, the addition amount of the inorganic high-rigidity wear-resistant material accounts for 8% to 12% of the total weight of the functional paint.

Preferably, the polymer powder with good toughness is any one or a mixture of two or more of nylon powder, polytetrafluoroethylene powder, polyester resin powder. Nylon powder, polytetrafluoroethylene powder and polyester resin powder are characterized by good toughness, and they exhibit very low friction coefficients when subjected to a friction with an external force, and therefore are capable of significantly improving wear-resistance of the material. These powdered resin materials are organic materials with a material structure similar to that of the base material and have a good adhesion. After treatment, the surfaces of these powders have a better compatibility with the base material, and the polymer powder particles have a stronger adhesion to the base material, with a much less possibility for the separation of the polymer powder particles and the base material during friction than the separation of the inorganic powder from the base material. In particular, while being subjected to an impact force, deformation of the flexible particles happens, which absorbs most of the impact force without destroying the flexible particles.

Preferably, the addition amount of the polymer powder accounts for 2% to 6% of the total weight of the functional paint.

The present invention also provides a light roofing system comprised of a waterproof substrate layer and a surface layer, the waterproof substrate layer being formed of a self-waterproof material, the surface layer comprising a functional material layer made from a functional paint, the functional paint comprising a base material and a functional material, the functional material comprising an inorganic flaky material, an inorganic high-rigidity wear-resistant material, and a polymer powder with good toughness, the addition amount of the inorganic flaky material accounting for 1% to 8% of the total weight of the functional paint, the addition amount of the inorganic high-rigidity wear-resistant material accounting for 2% to 15% of the total weight of the functional paint, and the addition amount of the polymer powder with good toughness accounting for 1% to 8% of the total weight of the functional paint.

Compared with the prior art, since the light roofing system of the present invention only comprises a substrate layer and a waterproof surface layer, and the waterproof surface layer comprises a functional coating layer formed of a functional paint, the waterproof surface layer provided replaces the technical solution with a multi-layered structure in the prior art, simplifies the construction, saves labor, resource and time, reduces the cost, and improves the efficiency. In the functional paint of the present invention, two kinds of powder particles (i.e., inorganic and organic particles) used have a coordinate effect during the friction of the base material, wherein the inorganic flaky material improves the thermal-insulation of the paint, the inorganic high-rigidity wear-resistant material bears the external friction force and the scratching effect and reduces the abrasion of the coating film layer; and the organic material, the polymer material with good roughness, bears the impact load, and meanwhile, polymer particles produced after abrasion of the polymer material distribute on the coating film surface and fill in the micropores thereon to make the surface more smooth, and as such the friction coefficient of the coating film surface and the abrasion of the coating film layer is reduced.

Because paint is used in all the materials of the present invention except the substrate layer, it is light and can effectively reduce the burden of the support mechanism, and avoid the unnecessary consumption of rebar materials as well as energy and construction materials during construction.

Since only a two-layer structure is employed in the present invention, the roofing structure is simple, and the materials used have similar expansion coefficients, water leakage phenomena caused by roof cracking can be effectively avoided.

Since only a two-layer structure is employed in the present invention, when damage and leakage of the roof occur, it is possible to troubleshoot visually and externally, and to specifically maintain the damaged sites, with less resource consumption, which can dramatically reduce the maintenance cost.

Since only a two-layer structure is employed in the present invention, a large amount of materials in the prior art are abandoned, and nontoxic paints with good flame resistance are used to form a surface layer, the problem about security risk is solved.

EMBODIMENTS

For those skilled in the art to better understand the technical solutions of the present invention, the present invention will be further illustrated in detail by means of the specific examples as follows.

EXAMPLE 1

Figure 1:
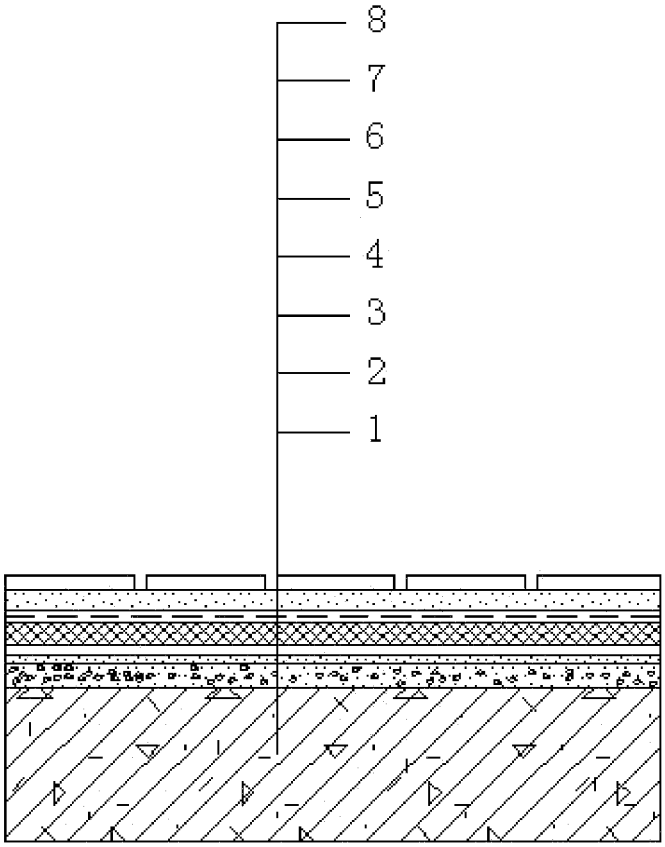
FIG. 1 is a structure diagram of a roofing system in the prior art.
Figure 2:
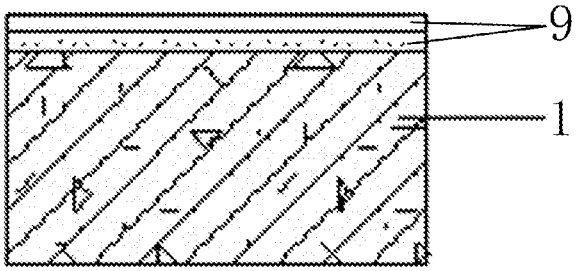
FIG. 2 is a structure diagram of example 1 of the light roofing system of the present invention.

Referring to FIG. 2, the light roofing system of this example comprises a substrate layer 1 and a waterproof surface layer 9, wherein the waterproof surface layer 9 comprises a waterproof coating layer made from a waterproof paint and a functional coating layer made from a functional paint, the waterproof coating layer is formed by directly coating the waterproof paint on the substrate layer 1, and the functional coating layer is formed by coating the functional paint on the waterproof coating layer. The substrate layer 1 can be formed of concretes, or metal or polymer materials, or wooden or roof tiles. In the present example, the substrate layer is comprised of non-self-waterproof materials, and the construction method is as follows:

As for a substrate layer comprised of non-self-waterproof materials, the waterproof paint can be coated on the substrate layer twice to form the waterproof coating layer, and then the functional paint is coated on the waterproof coating layer uniformly twice, to form the functional coating layer, and the light roofing system of this example is obtained. The light roofing system as a whole can achieve such effects as waterproofing and thermal-insulation. The more functions and the stronger functionality the paint has, and the thicker the coating is, the better functional effect the roofing system exhibits.

The above mentioned non-self-waterproof material is common concrete or mortar.

Breakage of the light roofing system in the present example appeared after long-term use thereof, and the broken sites could be visually found with naked eyes. After its external surface was cleaned and smoothed, coating in accordance with the above mentioned construction method could achieve the repair. In order to prolong the service life of the roofing, the roofing can also be treated wholly in accordance with this method.

The above mentioned method of producing the functional paint is identical to the traditional method of producing the exterior wall paint, in which a functional material is added in the pulping stage of the paint production, and then the method of producing a conventional paint is carried out, and thus the functional paint used in the present invention is obtained. In the roof of the present invention, the construction method of the reflective thermal-insulating paint is identical to the conventional method. Coating twice during the paint construction, and the coating film thickness of 0.3 mm to 0.5 mm can satisfy the thermal-insulating requirements. Examples 1 to 6 of functional paints used in the present invention are shown in table 1 below. Table 1 also provides the formulation of a reflective thermal-insulating paint in the prior art as a comparative example.

TABLE 1

| | (mass %) | | | | | | |
|---|---|---|---|---|---|---|---|
| Material | Example 1 | Example 2 | Example 3 | Example 4 | Example 5 | Example 6 | Comparative Example |
| Water | 19 | 19 | 19 | 19 | 19 | 19 | 19 |
| Aids | 3 | 3 | 3 | 3 | 3 | 3 | 3 |
| Thermal-insulating functional material | 22 | 22 | 22 | 22 | 22 | 22 | 22 |
| Filler | 4 | 2 | 1 | 1 | 5 | 3 | 18 |
| Emulsion resin | 38 | 38 | 38 | 38 | 38 | 38 | 38 |
| Micaceous iron oxide | 5 | | 1 | 8 | | | |
| Sericite powder | | 4 | | | 2 | 5 | |
| Zirconium oxide | 6 | | 15 | 2 | | | |
| Quartz powder | | 8 | | | 10 | 2 | |
| Polytetrafluoroethylene powder | 3 | | 1 | 7 | | | |
| Polyester resin powder | | 4 | | | 1 | 8 | |

In the above examples, micaceous iron oxide or sericite powder was selected as the inorganic flaky material, and in other examples, glass flake can also be selected as the inorganic flaky material. In addition, a mixture of any two or three of these materials can be selected as the inorganic flaky material. Other inorganic flaky materials with performances similar to the foregoing three kinds of materials can also be selected.

In the above examples, zirconium oxide or quartz powder was selected as the inorganic high-rigidity wear-resistant material, and in other examples, barite can also be selected as the inorganic high-rigidity wear-resistant material. Alternatively, a mixture of any two or three of these materials was selected as the inorganic high-rigidity wear-resistant material. Other inorganic high-rigidity wear-resistant materials with performances similar to the foregoing three kinds of materials can also be selected.

In the above examples, polytetrafluoroethylene powder or polyester resin powder was selected as the polymer powder with good toughness, and in other examples, nylon powder can also be selected as the polymer powder with good toughness. Alternatively, a mixture of any two or three of these materials can be selected as the inorganic high-rigidity wear-resistant material. Other polymer powder with good toughness with performances similar to the foregoing three materials can also be selected.

The paints prepared in the above examples and comparative example were used for roofing construction, and then comparison of their performances was carried out. The results were shown in table 2 below.

TABLE 2

Table of performance comparison

| Material | Example 1 | Example 2 | Example 3 | Example 4 | Example 5 | Example 6 | Comparative Example |
|---|---|---|---|---|---|---|---|
| Appearance | eligible | eligible | eligible | eligible | eligible | eligible | eligible |
| Coating property | eligible | eligible | eligible | eligible | eligible | eligible | eligible |
| Rigidity | high | high | high | low | high | low | low |
| Wear-resistance | excellent | excellent | excellent | good | excellent | good | general |
| Scratch resistance | excellent | excellent | good | good | good | good | general |
| Stain resistance | excellent | excellent | good | excellent | good | excellent | good |
| Weather resistance | excellent | excellent | good | excellent | good | excellent | good |
| Thermal-insulating effect | excellent | excellent | excellent | excellent | excellent | excellent | excellent |

It can be seen from table 2 that, each physical property of the coating film made from the functional paint used in the present invention is superior to that of the paint in the prior art.

EXAMPLE 2

Figure 3:
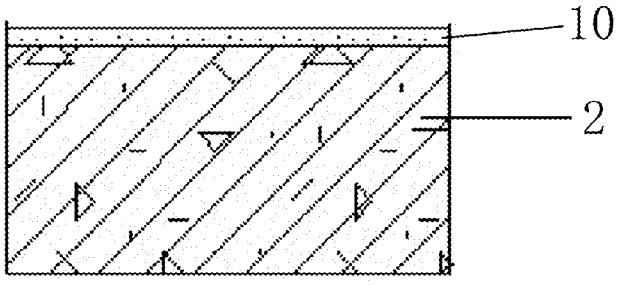
FIG. 3 is a structure diagram of example 2 of the light roofing system of the present invention.

Referring to FIG. 3, the light roofing system in the present example was comprised of a waterproof substrate layer 2 and a surface layer 10, the surface layer 10 being made from a functional paint, the waterproof substrate layer being made from a self-waterproof material, and the formulation and performance of the functional paint being the same as that of example 1 and will not be particularly described here.

The construction method of the light roofing system in the present example was as follows:

After the surface of the waterproof substrate layer was cleaned and smoothed, the functional paint was coated on the surface of the waterproof substrate layer twice, with a coating thickness of 0.3 mm to 0.5 mm.

In order to enhance the waterproof effect of the roof, the waterproof paint can be coated on the waterproof substrate layer twice firstly, and then the functional paint can be coated on the waterproof substrate layer uniformly twice, and the light roofing system in the present example is obtained. The light roofing system as a whole can achieve such effects as waterproofing and thermal-insulation. The more functions and the stronger functionality the paint has, and the thicker the coating is, the better functional effect the light roofing system exhibits.

The above mentioned self-waterproof material is waterproof concrete or waterproof mortar.

In other examples, a finish paint layer can be provided in the surface layer or the waterproof surface layer, that is, a layer of multi-functional finish paint is added on the functional paint layer for protection, and functions to enhance stain resistance, waterproofness and weather resistance of the roofing system.

In the functional paint used in the present invention, based on the actual requirements, other substances can be added to achieve corresponding functions. As a surface layer, the formed functional paint is combined with the substrate layer, forming a light roofing system with more functions.

The invention has been described in detail above. Specific examples are used herein to illustrate the principle and embodiments of the present invention. The explanation of the above examples is only for assisting in understanding the method of the invention and the core idea thereof. It should be noted that, various improvements and modifications can be made by those of ordinary skill in the art without departing from the principle of the present invention, which also fall within the scope of protection defined by the claims.

The invention claimed is:

1. A roofing system, characterized in that it is comprised of a substrate layer and a waterproof surface layer, the waterproof surface layer comprising a functional coating layer made from a functional paint and a waterproof layer made from a waterproof paint, the functional paint comprising a base material and a functional material, the functional material comprising an inorganic flaky material, an inorganic high-rigidity wear-resistant material and a polymer powder with good toughness, the addition amount of the inorganic flaky material accounting for 1% to 8% of the total weight of the functional paint, the addition amount of the inorganic high-rigidity wear-resistant material accounting for 2% to 15% of the total weight of the functional paint, and the addition amount of the polymer powder with good toughness accounting for 1% to 8% of the total weight of the functional paint, wherein the inorganic high-rigidity wear-resistant material is any one or a mixture of two or more of quartz sand, barite, and zirconium oxide, and the polymer powder with good toughness is any one or a mixture of two or more of nylon powder, polytetrafluoroethylene powder, and polyester resin powder.

2. The roofing system according to claim 1, characterized in that the waterproof layer is formed by coating the waterproof paint on the substrate layer.

3. The roofing system according to claim 1, characterized in that the waterproof surface layer further comprises a finish paint layer, which is located on the outmost side of the waterproof surface layer.

4. The roofing system according to claim 1, characterized in that the inorganic flaky material is any one or a mixture of two or more of sericite, glass flake, and micaceous iron oxide.

5. The roofing system according to claim 1, characterized in that the addition amount of the inorganic flaky material accounts for 3% to 5% of the total weight of the paint.

6. The roofing system according to claim 1, characterized in that the addition amount of the inorganic high-rigidity wear-resistant material accounts for 8% to 12% of the total weight of the functional paint.

7. The roofing system according to claim 1, characterized in that the addition amount of the polymer powder accounts for 2% to 6% of the total weight of the functional paint.

8. A roofing system, characterized in that it is comprised of a waterproof substrate layer and a surface layer, the waterproof substrate layer being formed of a self-waterproof material, the surface layer comprising a functional material layer made from a functional paint, the functional paint comprising a base material and a functional material, the functional material comprising an inorganic flaky material, an inorganic high-rigidity wear-resistant material, and a polymer powder with good toughness, the addition amount of the inorganic flaky material accounting for 1% to 8% of the total weight of the functional paint, the addition amount of the inorganic high-rigidity wear-resistant material accounting for 2% to 15% of the total weight of the functional paint, and the addition amount of the polymer powder with good toughness accounting for 1% to 8% of the total weight of the functional paint, wherein the inorganic high-rigidity wear-resistant material is any one or a mixture of two or more of quartz sand, barite, and zirconium oxide, and the polymer powder with good toughness is any one or a mixture of two or more of nylon powder, polytetrafluoroethylene powder, and polyester resin powder.

* * * * *